United States Patent [19]

Anhalt et al.

[11] Patent Number: 4,634,199

[45] Date of Patent: Jan. 6, 1987

[54] CONNECTOR ASSEMBLY FOR MAKING MULTIPLE CONNECTIONS IN A THIN SPACE

[75] Inventors: John W. Anhalt, Orange; David S. Goodman, Mission Viejo; Gerald J. Selvin, Huntington Beach, all of Calif.

[73] Assignee: ITT Corporation, New York, N.Y.

[21] Appl. No.: 693,408

[22] Filed: Jan. 22, 1985

[51] Int. Cl.[4] ..... H01R 9/09

[52] U.S. Cl. ..... 339/17 M

[58] Field of Search ..... 339/17 M, 17 LM, 59 M, 339/61 M, 17 CF

[56] References Cited

U.S. PATENT DOCUMENTS

| | | | |
|---|---|---|---|
| 3,795,037 | 3/1974 | Luttmer | 339/17 M |
| 3,954,317 | 5/1976 | Gilissen et al. | 339/17 M |
| 3,960,423 | 6/1976 | Weisenberger | 339/59 M |
| 3,963,315 | 6/1976 | Bonis | 339/17 CF |
| 4,161,346 | 7/1979 | Cherian et al. | 339/17 M |
| 4,199,209 | 4/1980 | Cherian et al. | 339/17 M |

OTHER PUBLICATIONS

IBM Bulletin, Faure et al, vol. 17, No. 2, p. 444, 7-1974.

*Primary Examiner*—Neil Abrams

*Attorney, Agent, or Firm*—T. L. Peterson; R. C. Turner

[57] ABSTRACT

A connector assembly is described for fitting in a small space between a display panel device and a printed circuit board device, to electrically connect a multiplicity of closely-spaced conductors on the devices. The connector assembly includes a row of contact elements with opposite ends for contacting the conductors of the devices, and with curved middle portions that are nested in one another. The middle portions of the elements are sandwiched between the substantially flat faces of a housing, and the opposite ends of the elements project through openings in the housing.

3 Claims, 7 Drawing Figures

CONNECTOR ASSEMBLY FOR MAKING MULTIPLE CONNECTIONS IN A THIN SPACE

BACKGROUND OF THE INVENTION

A display panel device can be energized by a circuit on a circuit board device by placing the devices in parallel planes and interconnecting their multiplicity of electrical traces or conductors that are located near their peripheries. Because of the large number of conductors to be interconnected and their close spacing such as at 0.030 inch, it is of importance to provide a connector assembly which is very compact and of low cost, and which provides reliable connection.

SUMMARY OF THE INVENTION

In accordance with one embodiment of the present invention, a connector apparatus is provided which can fit into the small space between a pair of boards or panels that lie in parallel planes to connect conductors on each of them, which is reliable and of low cost. The apparatus includes a row of contact elements with bent middle portions that nest in one another. A housing which holds the elements spaced apart along the row, can include openings that receive opposite ends of the elements to fix the spacing of the elements, and can also include a pair of largely flat faces on opposite sides of the middle portions of the elements.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
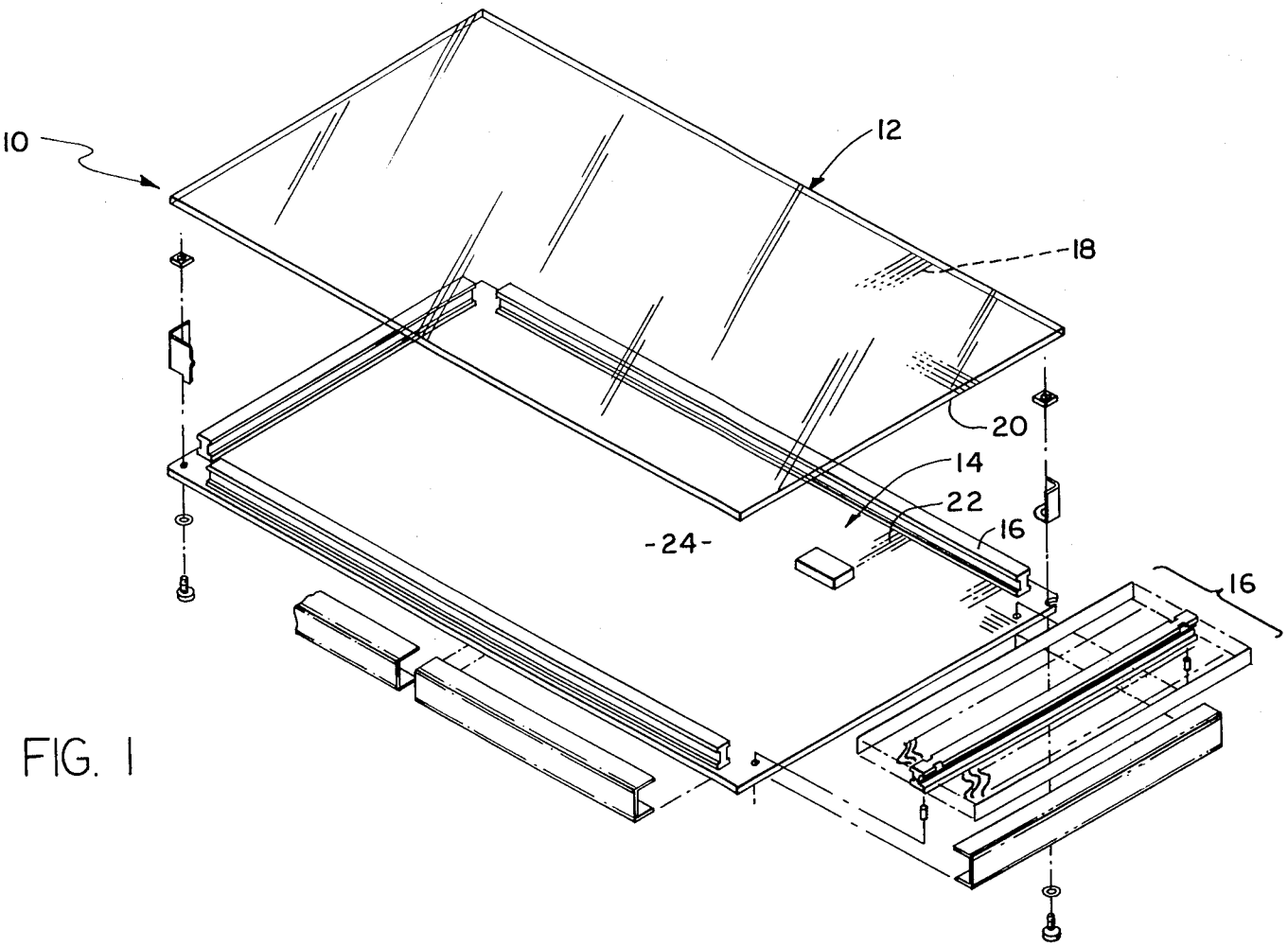
FIG. 1 is an exploded perspective view of a display panel assembly which includes connector assemblies of the present invention.
Figure 2:
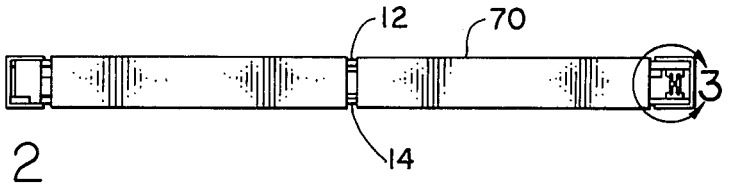
FIG. 2 is an edge view of the display assembly of FIG. 1.

FIG. 1 illustrates a display assembly 10 which includes a display panel 12, a circuit board 14, and a group of connector assemblies 16 lying between them. The panel has a large number of conductive traces or conductors 18 on its back face 20, and the circuit board has a large number of corresponding conductors 22 on a face 24 that faces the panel. The display panel and circuit board lie in closely-spaced parallel planes, and the connector assemblies 16 are designed to fit into the small space and connect the multiple conductors 18, 22. In this particular arrangement, there are four connector assemblies 16, for connecting each of the four sides of the panel and board devices.

Figure 3:
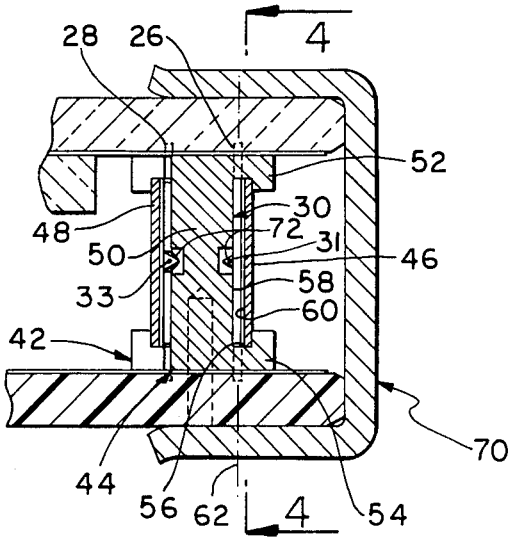
FIG. 3 is an enlarged view taken on the line of 3—3 of FIG. 2.
Figure 4:
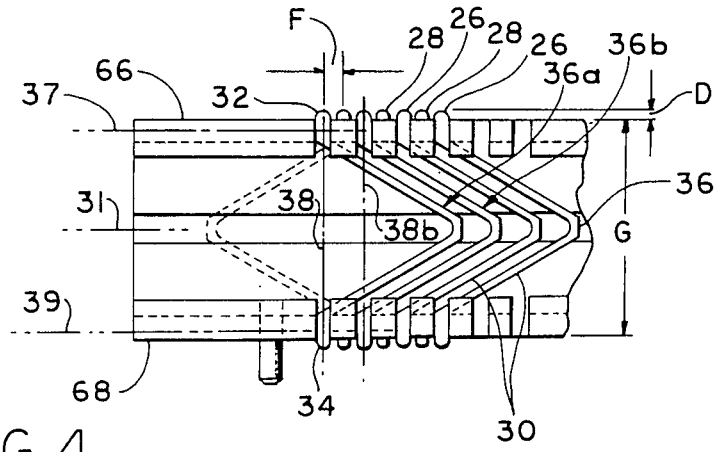
FIG. 4 is a partial view taken on the line of 4—4 of FIG. 3.

As shown in FIG. 3, the connector assembly includes two rows 26, 28 of contact element 30 whose middles lie on row lines 31,33. As shown in FIG. 4, each contact element includes a pair of opposite ends 32, 34 and a middle 36. The opposite ends of each element are aligned, and lie on an imaginary line 38. The middle portion 36 of the element is curved or bent so that it does not lie on the line 38 and is therefore out of line with the ends. As shown in FIG. 4 (and FIG. 7), the middle portion 36 is preferably shaped into generally straight leg portions curved or bent at a central apex forming an acute angle between the leg portions. The acute angle can uniformly range from 45°–89° and is preferably about 60°. The middle portion 36 of the row of contact elements are nested in one another. The nesting is sufficiently close that a middle portion of one element **36*a* lies on and crosses an imaginary line 38*b* which connects the opposite ends of another element 36*b* of the same row. The opposite ends of the elements of one row such as 31 lie on lines 37,39 that are parallel to each other and to the row line 31**.

The contact elements are formed of sheet metal, by stamping them out of a sheet of resilient conductive material such as phosphor bronze. The thickness of each contact element is constant in a direction perpendicular to both the end-connecting line 38 and the row lines 31,33 but varies in a direction perpendicular to the sheet thickness. In other words, as viewed along a row line 31 (FIG. 5), the element has a variable thickness. As viewed along an outside line 41 that is perpendicular to both the row line 31 and the end-connecting line 38, the element has a constant thickness. Instead of considerably bending a stamped-out contact element, it is already stamped so that the middle portion forms an acute angle, and only minor bending (at tab 72) is performed thereon, all of which results in low cost and high uniformity of the contact elements. The spacing of the elements so their middle portions nest in one another enables low cost mounting of the elements in an arrangement that requires very little space.

As shown in FIG. 3, the elements are held in position by a housing 42 which includes a beam 44 and a pair of retaining plates 46, 48. The beam 44 includes a central rib 50 and a pair of end plates at its opposite ends which form a pair of flanges 52, 54 on either side. Each flange has an elongated recess 56. The retainers, or retaining plates such as 46, and a row 31 of contact elements, are received in the recess. The rib 50 and a retaining plate 46 form a pair of largely flat surfaces 58, 60. A row of elements 30 is sandwiched between the surfaces, to confine the middle portions of the elements so that they and their ends all lie in substantially the same plane such as 62. It should be understood that that the rib and plate can have grooves that occupy most of their surfaces, so long as they support the elements to lie in a flat plane.

Figure 5:
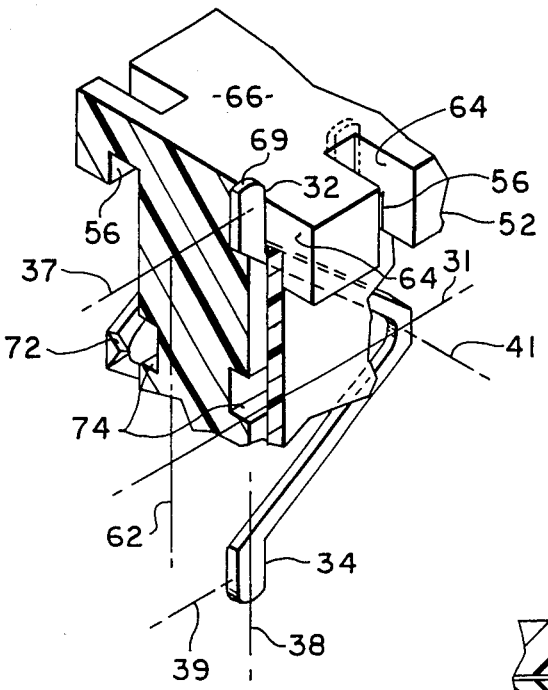
FIG. 5 is a partial perspective view of the connector assembly of FIG. 3.

As shown in FIG. 5, each flange such as 52 has a row of through openings 64 through which an end 32 of each element projects. These openings 64 (which connect to the recess 56) maintain a predetermined spacing of the elements along the row. The opposite ends of the elements are biased apart so that they project a small distance D (FIG. 4) above a corresponding face 66, 68 of the housing before the connector assembly is installed. When a connector assembly is installed between the display panel and circuit board, its opposite faces 66, 68 abut the panel and board to determine their separation. With such installation the ends 32, 34 of the contact elements are deflected inwardly by the small amount D until their tips 69 are even with the opposite faces 66, 68. A cover spring 70 which fits around the edges of the panel and circuit board, presses them tightly together against opposite sides of the connector assembly. The contact elements can be formed with tabs 72 (with FIG. 5) that are received in grooves 74, to limit the up and down movement of the middle portions of the contact assemblies, to insure that they do not touch one another.

Although the contact elements are closely spaced along each row, the use of two rows, with the contact elements in staggered positions along the rows, permits the connection of traces or conductors on a display panel and a circuit board, that are very closely spaced, while permitting somewhat greater spacing of the contact elements along each row.

A system has been designed to connect conductors on a display panel and circuit board that were spaced a distance F (FIG. 4) apart of 0.030 inch. Contact elements formed of sheet metal, were used with only the tabs 72 bent out of the plane out of the sheet metal of which they were formed. The distance G between the ends of the elements was 0.280 inch, and each element projected a distance D of 0.010 inch prior to its installation.

Figure 6:
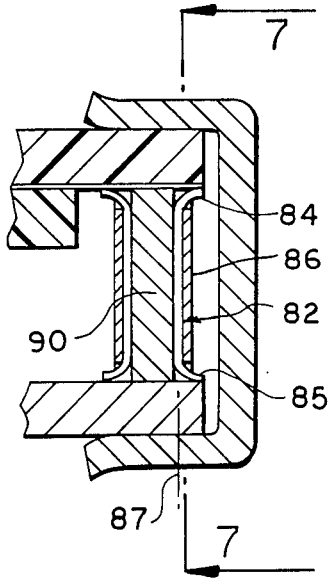
FIG. 6 is a sectional view of a connector assembly constructed in accordance with another embodiment of the invention.
Figure 7:
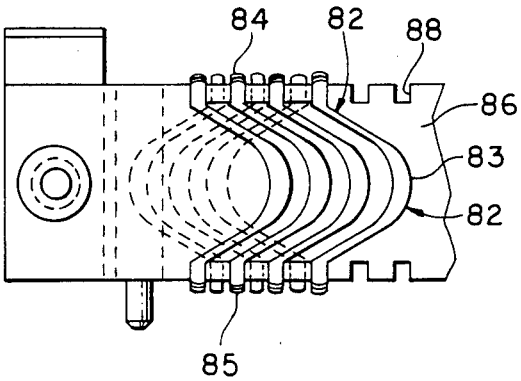
FIG. 7 is a view taken on the line 7—7 of FIG. 6, but with part of the retaining plate shown in phantom lines.

FIGS. 6 and 7 illustrate some details of another embodiment of the invention that was designed prior to that of FIGS. 1–6. In the connector assembly of FIGS. 6 and 7, the contact elements 82 also have middle portions 83 that are nested in one another, so that an entire row of contact elements lie substantially in one plane. While the contact elements 82 were formed from sheet metal, their opposite ends 84, 85 were bent out of the common plane 87 of most of the element. Such bent ends were provided in order that they may be captured in a retainer plate 86 which had slots 88 which received the ends of the elements. The retainer plate 86 was fastened at its opposite ends to a center beam 90, and was also held by elastomeric cement at its middle portions to the beam.

Thus, the invention provides a connector assembly for interconnecting the conductors or traces of a pair of boards or panels, which is of high reliability and low cost. The connector assembly includes at least one row of contact elements with bent middle portions that permit resilient compression of the opposite ends, and means for holding the contact elements in rows so that the middle portions of the contact elements are nested in one another. The contact elements can be held by a housing which includes a pair of largely flat surfaces, with the contact elements sandwiched between them. The housing can be formed by a beam having opposite sides that abut against the panel or board devices, and a retainer plate lying beside the beam, with the elements sandwiched between them. The contact elements can be formed of sheet metal, with most of the element lying flat in the plane of the sheet metal, and with each contact element originally punched out of a sheet of metal so that it originally had a bent middle portion.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A connector apparatus for fitting in the small space between a panel and a circuit board to electrically connect a multiplicity of closely-spaced conductors of the panel to a multiplicity of corresponding contacts of a circuit board, comprising:

a row of contact elements, each having first and second opposite ends and a middle, each element being bent so the middle is out of line with the ends to enable compression to allow the ends to resiliently move together and apart;

means for holding said elements spaced apart along said row with said first ends being spaced apart along a first row line, said second ends being spaced apart along a second row line, said middles being spaced apart along a third row line, and said first, second and third row lines lying in substantially the same plane; and the bent middles of said elements which lie in said row are nested in one another; and said means for holding includes a largely beam shaped housing having a center rib and opposite flanges, each of said flanges having an elongated recess beside the rib, and said means for holding also include a retaining plate that has opposite sides that lie in said recesses, each of said flanges having a row of spaced openings for receiving the ends of said contact elements, said openings being connected to said recess, and said row of elements lie between said retaining plate and said center rib, with the ends of said elements projecting through said openings in said flanges.

2. The apparatus described in claim 1 including:

a display panel device, and a circuit board device lying in spaced parallel planes, each including a multiplicity of closely-spaced electrical conductors near its periphery that faces the conductors of the other device;

said row of elements lies sandwiched between said devices with opposite ends of each contact element in contact with conductors on different ones of said devices;

said means for holding said elements further includes said housing which lies between said devices and which has opposite faces that abut said devices to maintain at least a predetermined separation of said devices, the extreme ends of said contact elements being separated by more than said predetermined separation when not lying between said devices; and a resilient cover clip having opposite sides lying on the sides of said devices that are opposite said elements and a middle connecting said opposite sides, said clip squeezing said devices and elements together to compress said elements sufficiently so their tips lie even with said faces of said housing.

3. A connector assembly for fitting in the small space between a display panel device and a circuit board device to electrically connect a multiplicity of closely-spaced conductors near the perimeter of the panel device to a multiplicity of corresponding contacts of the circuit board device, comprising:

a housing of electrically insulative material having the shape of an elongated beam that has a center rib with a largely flat face and at least one flange at each end, each flange having an outer face that bears against one of said devices and an inner face, each flange having a recess in the inner face of the flange which lies adjacent to said rib, and each flange having a through opening extending from one face of the flange and through the recess to the other face of the flange;

a retainer in the form substantially of a plate having opposite sides lying in said recesses and having a face that faces said rib;

a row of contact elements, each having opposite ends extending through a pair of openings in different flanges, and a middle portion, said middle portions of said row of elements lying in substantially a common plane and being nested in each other;

the middle portions of said elements lying sandwiched between a face of said rib and the face of said retainer.

* * * * *